United States Patent [19]

Jáki et al.

[11] Patent Number: 4,823,490

[45] Date of Patent: Apr. 25, 1989

[54] SIGNAL DISPLAY ELEMENT FOR THE SELECTIVE DISPLAY OF INFORMATION WITH ELECTROMAGNETICALLY ACTUATED TILTING PLATES

[75] Inventors: László Jáki; Sándor Jodál; József Mandzsu; Endre Pap, all of Budapest, Hungary

[73] Assignee: Fok-Gyem Finommechanikai es Elektronikus Muszergyarto Szovetkezet, Hungary

[21] Appl. No.: 918,773

[22] Filed: Oct. 14, 1986

[30] Foreign Application Priority Data

Oct. 11, 1985 [HU] Hungary ..... 3947/85

[51] Int. Cl.[4] ..... G09F 9/00

[52] U.S. Cl. ..... 40/449; 116/204; 340/815.01; 340/815.20; 340/815.26

[58] Field of Search ..... 40/449, 446, 530, 532, 40/533, 534, 463; 402/79; 340/783, 815.26, 815.1, 815.20, 815.26; 116/204

[56] References Cited

U.S. PATENT DOCUMENTS

| | | | |
|---|---|---|---|
| 3,895,453 | 7/1975 | Wright | 402/79 |
| 3,916,403 | 10/1975 | Mandzsu et al. | 340/783 |
| 4,070,668 | 1/1978 | Kawaharada et al. | 340/815.26 |
| 4,259,801 | 4/1981 | Ito | 40/449 |
| 4,528,932 | 7/1985 | Ducza et al. | 340/815.26 |

FOREIGN PATENT DOCUMENTS

| | | | |
|---|---|---|---|
| 3335922 | 4/1985 | Fed. Rep. of Germany | 40/449 |
| 427536 | 2/1975 | U.S.S.R. | 340/815.1 |
| 18286 | of 1911 | United Kingdom | 40/449 |
| 679135 | 9/1952 | United Kingdom | 40/5 |

*Primary Examiner*—Gene Mancene
*Assistant Examiner*—J. Hakomaki
*Attorney, Agent, or Firm*—Handal & Morofsky

[57] ABSTRACT

Signal display element for the display of more than two informations by electromagnetically excited magnetic tilting plates, wherein at least two tilting plates in stable condition are arranged and supported in bearings on a baseplate for covering the surfaces of the baseplate carrying the information, the single tilting plates are supported in bearings preferably on two places and displaced in relation to each other, the distance between the common geometric axis of revolution of the tilting plates and the baseplate equals to, or is larger than the half of the total thickness of the tilting plates bearing up against one another.

6 Claims, 3 Drawing Sheets

SIGNAL DISPLAY ELEMENT FOR THE SELECTIVE DISPLAY OF INFORMATION WITH ELECTROMAGNETICALLY ACTUATED TILTING PLATES

FIELD AND BACKGROUND OF THE INVENTION

The invention relates to a signal display element for the display of more than two informations for display by electromagnetically excited tilting plates, wherein in said signal display element at least two tilting plates in stable condition are arranged, supported in bearings on a baseplate and being suitable for covering the surfaces of the baseplate carrying the informations. As it is well known, signal displaying elements for the visual display of numbers, signals and symbols e.g. those described in Hungarian Patent HU-PS No. 157,250, and which are provided with tilting plates to be tilted by means of electromagnetic control and in such a manner that under influence of a tilting motion one or the other side of the plates becomes visible. The plates can also be tilted around a lateral edge or an edge running parallel with the lateral edge. The two surfaces of the tilting plates carry different informations, they are e.g. differently colored, while the part of the baseplate which became visible, carries an identical information, e.g. it has the same colour, as the visible surface of the tilting plate. The tilting plates are made, at least partly of a permanent magnetic material, the magnetic axis of which is preferably perpendicular to the plane of the tilting plates. Accordingly, by means of each signal display element two different informations can be displayed.

Furthermore an element functioning on the principle of signal display as previously described, is known, which is well suitable for displaying more than two informations, such a display is specified in Hungarian Patent HU-PS No. 158 828. In contrast to the earlier mentioned solution, in the latter case the axes of rotation of the signal display elements are not fixedly supported in bearings, but they are capable of moving when guided inside of U-shaped (hairpin) bearings, similarly, as books and covers provided with filler sheets. With this solution a plurality of tilting plates can be arranged in one element and the number of the informations to be displayed, i.e. colors, exceeds by one the number of the tilting plates.

The disadvantageous feature of that solution lies in that prior to turning, the tilting plates must be lifted in their entirety, requiring far more energy than the tilting. Functioning of the elements is uncertain, as the tilting plates tend to mesh, with their edges lying inside the bearings.

SUMMARY OF THE INVENTION

The invention is based on the recognition that in so far as several tilting plates, which can be superimposed on each other, can be tilted in the region of one of their lateral edges around an axis, and even if they are fixedly supported in bearings, if the tilting plates are displaced with respect to each other at least on two places, in a hinge-like manner, therefore, that in one stable position all the tilting plates arranged on the baseplate or on another tilting plate and are lying in an identical distance from the plane crossing the common geometric axis of rotation of the tilting plates and running parallel with the base plate of the display element (in an extreme case this distance may amount to zero), however, they are arranged on the opposite side of the plane crossing the axis of rotation and running parallel with the base plate.

The essence of the invention lies in that the tilting plates are displaced with respect to each other and supported in bearings preferably on two places; furthermore, the distance between the common geometric axis of rotation and the baseplate equals to or it is larger than the half of the total thickness of all the tilting plates bearing up against each other.

BRIEF DESCRIPTION OF THE DRAWINGS

The invention will be described in details by preferred embodiments serving as examples, by the aid of the drawings enclosed, wherein FIG. 5 is an axonometric view of the arrangement of the plate bearings symmetrically with the centerline, while

DESCRIPTION OF THE PREFERRED EMBODIMENT

Figure 1:
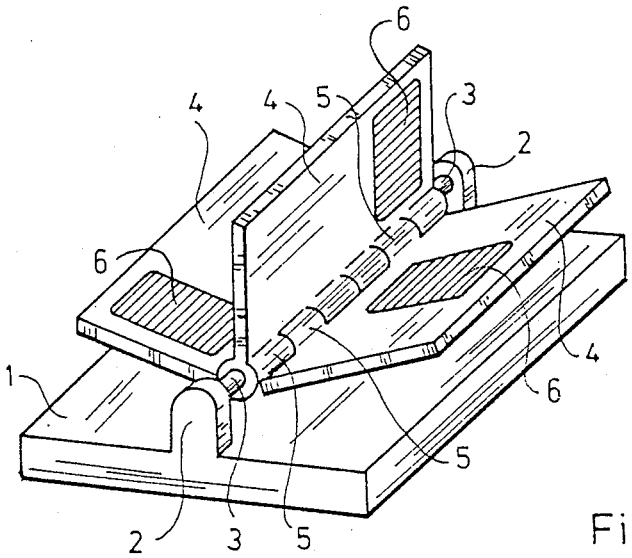
FIG. 1 is an axonometric scheme of a signal display element according to one preferred embodiment of the invention, provided with three tilting plates.

As can be seen in FIG. 1, in the signal display element, between the bearing housing 2 fixed on the baseplate 1 tilting plates 4 are supported in bearings 5 on the common axis 3. The two sides of a tilting plates 4 are information carrying surfaces, the surface of the baseplate, which can be covered with the tilting plates 4, is carrying also an information. The tilting plates 4 each are displaced in relation to each other and the y are supported in bearings preferably on two places on the common axis 3; to achieve this, two (eventually more, let us say three) plate-bearings 5 formed in a hinge-like manner are attached to the single tilting plates 4, preferably forming a monolithic unit with the tilting plate 4.

Prerequisite of applying two or more tilting plates 4 in a signal display element lies in that the tilting plates 4 should lie accurately on one another and on the baseplate 1, respectively. To achieve this, the distance between the geometric axis of rotation of the tilting plates 4 and the surface of the baseplate 1 must be equal to or larger than the half of total thickness of all the tilting plates 4 bearing up against each other, however, it cannot be less. Accordingly, the outer diameter of the bearings 2 respectively the plate-bearings 5 is smaller, than the total thickness of the tilting plates 4 bearing up against each other, or being equal to the total thickness of all the tilting plates 4 bearing up against each other, however, it cannot be larger.

Prerequisite of actuation of a signal display element having two or more tilting plates 4 lies in that magnetized parts 6 of the single tilting plates 4 should be displaced axially in relation to one another. In such a manner it can be achieved that the magnet of each of the tilting plates could be excited separately, while putting into motion the other tilting plates 4 according to necessity, by "turning over the pages" the information required can be displayed with the moved tilting plate 4.

Figure 2:
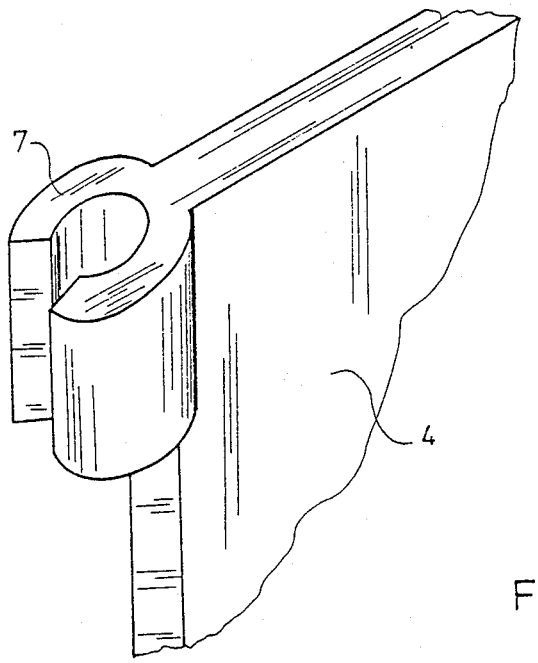
FIG. 2 is an axonometric view of the bearing.

FIG. 2 shows another embodiment of the arrangement of the bearings. The figure shows a plate-bearing 7, which is slit on the side opposite to its generatrix connected to the tilting plate 4 in the axial direction and the width of the slit is less than the diameter of the axis 3. Width of the slit is determined so, that owing to its elasticity the plate-bearing 7 could be snapped onto the axis 3. In such a manner operation of "stringing" onto the axis 3 becomes superfluous.

Figure 3:
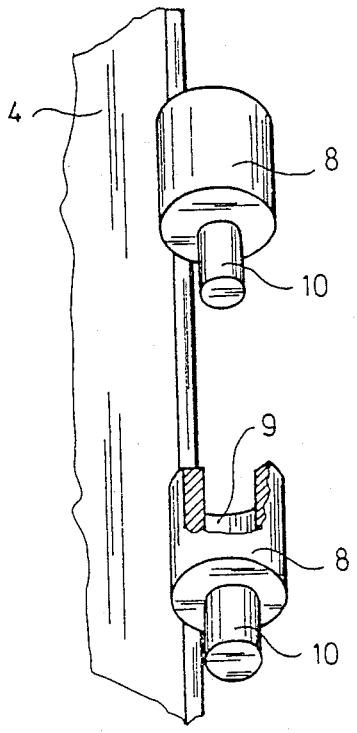
FIG. 3 is an axonometric view of the bearings and pins in another preferred embodiment.

FIG. 3 illustrates a further possible arrangement of the bearings. In this case thrust bearings 8 are fixed to the tilting plates 4 manufactured advantageously from one piece with the tilting plates 4 with which, on one of the frontal surface of the thrust bearings 8 pins 10, preferably cylindrical 10, extend into the coaxial indents 9 of the shape of a surface of revolution formed on the other frontal surfaces of the confining thrust bearing 8, preferably bores, while the pins 10 correspond to the shape of the indents 9 having a coaxial shape of a surface of revolution.

Figure 4:
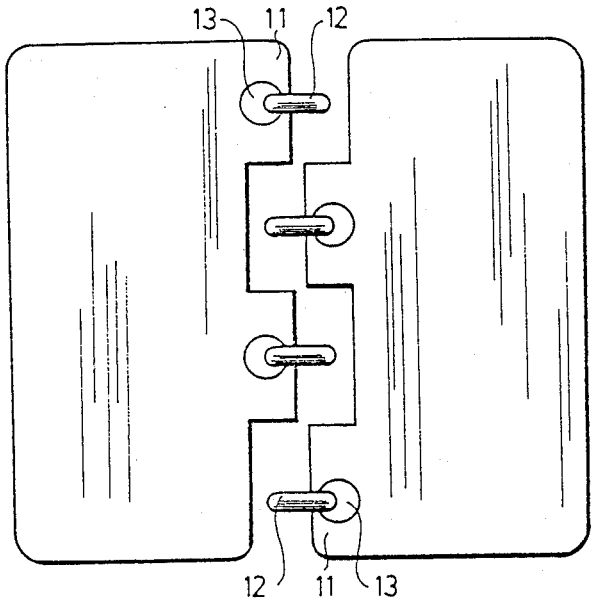
FIG. 4 is a further embodiment realized with a radial bearing, provided with two tilting plates.

FIG. 4 illustrates a mode of support in bearings, which mode is quite different from the former one, where the hairpin-bearings of the signal display element carry one tilting plate 4. With this solution the tilting plates 4 are provided with extensions 11, instead of the plate-bearings 5 and in their place the extensions 11 are in the form of sheets with a thickness corresponding to the thickness of the tilting plates 4. In extensions 11, preferably in an identical distance from the edge of the tilting plates 4, bores 13 are formed advantageously in contact with the edge of the tilting plates 4 and serving as bearings for the hairpin axis 12. A hairpin axis 12 one to every bore 13, accordingly, their numbers are identical. The size of the extensions 11 of the tilting plates 4 lying perpendicularly to the axial direction, reckoned from the bore 13 to the axial edge of the extension 11, is less, than the distance between the shanks of the hairpin-axis 12. This is namely the prerequisite of unhindered tilting of the tilting plate 4, when it is guided by the hairpin axis 12.

Total length of the plate-bearings 5, respectively thrust bearings 8, respectively extensions 11 belonging to a single tilting plates 4 can equal to or being preferably less, than the length obtained by dividing the length of the tilting plates 4 by the number of the tilting plate 4.

Plate-bearings 5, 7 or the thrust bearings 8 or the extensions 11 are arranged on the tilting plate 4 symmetrically, on the centerline being perpendicular to the axis of revolution of the tilting plate 4. This arrangement is to be seen in FIG. 5.

Figure 6:
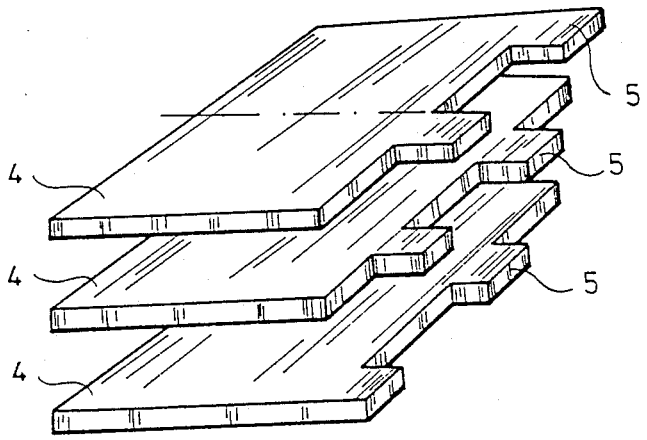
FIG. 6 shows an axonometric view of the repeated arrangement of the plate bearings on the tilting plates, beginning from the centreline running perpendicularly to the axis.

With another preferred embodiment the plate-bearings 5, 7 or the thrust bearings 8 or the extensions 11 are arranged on the tilting plates 4 so, that beginning from the centerline running perpendicularly to the geometric axis of the tilting plates 4, the elements are repeatedly arranged, as it becomes obvious from FIG. 6.

Figure 5:
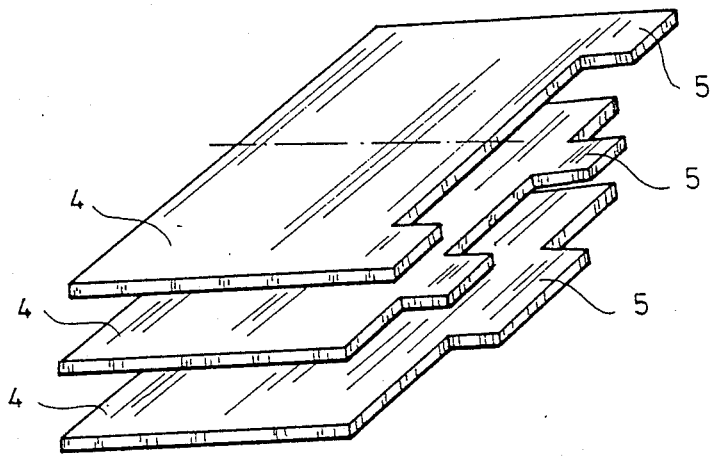

In the event if more, than two plate-bearings 5, 7 or thrust bearings 8 are arranged on the tilting plate 4, the arrangement according to FIG. 5 will be modified so, that tilting plates 4 are to be divided in as many parts by the parting line which is perpendicular to the revolution as the number of the plate-bearings 5, 7 or thrust bearings 8 having been arranged on the tilting plate 4, and repeated arranging may start from the parting lines.

The signal display element according to the invention operates, as follows:

After having displaced the magnetized parts 6 on the tilting plates 4 axially, they can be operated independently of each other. If all the tilting plates 4 are bearing up against one another on one side, full turn can be carried out in two ways. Either only the magnetic field of the lowest tilting plate 4 is excited and, as a consequence, this will be turned and pushes all the other tilting plates 4 before itself due to repulsion, or magnetic fields of the tilting plates 4 are excited one after the other, starting from the bottom and advancing upwards, while the tilting plates are "turned over as pages" and thus tilted. The former process requires a relatively high expenditure on energy, thus it seems to be more expedient to turn them over as pages.

The invention is not restricted to the examples described but it encompasses all the solutions according to the claims, in particular to the broad claim.

What we claim:

1. Signal display element for the selective exhibition of more than two informational displays comprising a plurality of electromagnetically excited magnetic titling plates, tiltable about an axis of rotation wherein at least two of said tilting plates may be arranged in a stable condition covering information carrying surfaces of a baseplate, each of said tilting plates supported by bearings at a minimum of two points, said bearings displaced with respect to the placement of the bearings of each other tilting plate in the display element, said axis of rotation of the tilting plate distanced from said baseplate by at least one half of the total thickness of said tilting plates bearing up against one another, wherein an axle is supported on said base plate along said axis of rotation for mounting said tilting plates thereon, said bearings being slit-plate-bearings having a slit running axially on the side lying opposite to the connection of the bearing to the tilting plate and in a width less than the diameter of the axle, said tilting plates (are) being thus adapted to be snapped onto the axle.

2. Signal display element for the selective exhibition of more than two informational displays comprising a pluarlity of electromagnetically excited magnetic tilting plates, tiltable about an axis of rotation wherein at least two of said tilting plates may be arranged in a stable condition covering information carrying surfaces of a baseplate, each of said tilting plates supported by bearings at a minimum of two points, said bearings displaced with respect to the placement of the bearings of each other tilting plate in the display element, said axis of rotation of the tilting plate distanced from said baseplate by at least one half of the total thickness of said tilting plates bearing up against one another, wherein, thrust bearings are fixed to the tilting plates and on a frontal surface of at least one of the thrust bearings a pin with a coaxial surface of revolution is dimensioned to extend into an indent made in a facing frontal surface of an adjacent thrust bearing.

3. Signal display element as claimed in claim 2, wherein the thrust bearings have an outer diameter no greater than the total thickness of all the tilting plates bearings up against each other.

4. Signal display element as claimed in claim 2, wherein the individual thrust bearings have a total axial length no greater than a length obtained by dividing the length of an edge of the tilting plates communicating with said thrust bearing by the number of the tilting plates.

5. Signal display element as claimed in claim 2, wherein the thrust bearings are arranged symmetrically on the axis of rotation with respect to a midpoint on said axis.

6. Signal display element as claimed in claim 2, wherein the thrust bearings are arranged on individual tilting plates so that they are an identical distance form one another on each of said individual tilting plates.

* * * * *